United States Patent [19]

Warnan et al.

[11] Patent Number: 4,991,534

[45] Date of Patent: Feb. 12, 1991

[54] DEVICE DESIGNED TO KEEP A TOWED UNDERWATER VEHICLE SUBMERGED AND METHOD FOR THE USE OF SAID DEVICE

[75] Inventors: Francois Warnan, Trappes; Bernard Hébert, Cagnes sur Mer, both of France

[73] Assignee: Thomson-CSF, Puteaux, France

[21] Appl. No.: 416,708

[22] Filed: Oct. 3, 1989

[30] Foreign Application Priority Data

Oct. 11, 1988 [FR] France ..... 88 13337

[51] Int. Cl.[5] ..... B63B 21/66

[52] U.S. Cl. ..... 114/245

[58] Field of Search ..... 114/244, 245, 253, 254, 114/242

[56] References Cited

U.S. PATENT DOCUMENTS

| | | | |
|---|---|---|---|
| 2,414,480 | 1/1947 | Morrill | 114/244 |
| 3,062,171 | 11/1962 | Somerville | 114/245 |
| 3,137,264 | 6/1964 | Brainard et al. | 114/244 |
| 3,434,451 | 3/1969 | Brainard | 114/244 |
| 3,645,224 | 2/1972 | Haberman | 114/245 |
| 3,842,770 | 10/1974 | Hedbawny et al. | 114/245 |
| 4,252,074 | 2/1981 | Blaisdell | 114/245 |

FOREIGN PATENT DOCUMENTS

| | | |
|---|---|---|
| 2496277 | 6/1982 | France . |
| 2193476 | 2/1988 | United Kingdom . |

*Primary Examiner*—Sherman Basinger
*Assistant Examiner*—Stephen P. Avila
*Attorney, Agent, or Firm*—Roland Plottel

[57] ABSTRACT

A depresser designed to keep a fish, towed by a ship, submerged comprises a flat swept wing joined to the towing cable by means of three suspenders making it possible to set it at an optimal angle of incidence. This enables a fish to be towed at a high speed which may go up to 30 knots while, at the same time, keeping it at a substantially constant depth of submersion.

8 Claims, 2 Drawing Sheets

DEVICE DESIGNED TO KEEP A TOWED UNDERWATER VEHICLE SUBMERGED AND METHOD FOR THE USE OF SAID DEVICE

BACKGROUND OF THE INVENTION

1. Field of the Invention

The present invention concerns devices that enable underwater vehicles or equipment such as sonars, towed behind ships, to be kept submerged at a substantially constant depth. Such devices are known in the prior art as hydrodynamic depressers.

2. Description of the Prior Art

As shown in FIG. 1, it is common practice to tow an underwater vehicle 103, called a fish, behind a ship 101. This vehicle 103 is pulled by means of a cable 104. This fish has a variety of instrument systems, for example a sonar designed to map the ocean bed. This fish has to be maintained at an submersion depth H which is sufficient, inter alia, to get rid of the effects of surface noises to the maximum extent. It is also very desirable for this submersion depth to be kept as constant as possible.

It is quite clear that, because of the drag shown by the fish and also by the cable, the faster the ship goes, the more will the fish tend to rise towards the surface.

To prevent this, it is common to use a depresser 105 with a shape designed so that its head resistance tends, on the contrary, to make it plunge, in dragging along the cable to which it is hooked and the fish hooked to the cable. The dimensions of this whole unit are designed so that the vertical forces exerted on the fish and on the depresser cancel each other, preferably in the widest possible range of speeds.

Essentially two types of depressers are known:

A first model, shown in FIG. 2, comprises a set of flaps 202 held by two vertical panels 203. These panels are hooked to four suspenders 201, the relative lengths of which enable the flaps to be maintained with an angle of incidence enabling the necessary downward thrust to be obtained. A depresser such as this is relatively compact, but works accurately only at low speeds. Moreover, the drag forces due to the vertical panels 203 are relatively great, without any advantages being provided by these panels.

A second model, manufactured notably by the firm ENDECO Incorporated at MARION (Massachussets), U.S., is formed by a delta wing that has a fairly accentuated negative dihedron and is provided with a vertical aileron. This wing is hooked on at a single anchoring point located slightly in front of the center of the wing. The central aileron, which is necessary to ensure the rolling stability, itself also has a high level of unwanted roll. Besides, the pitching stability of such devices is relatively low.

SUMMARY OF THE INVENTION

According to the invention, there is proposed a device designed to keep an underwater vehicle, towed by a ship by means of a towing cable, submerged at a substantially constant depth, said device comprising an swept wing and three suspenders fixed, by one side, respectively to the tip and to the two rear ends of the wing and, by the other side, at one and the same point of the towing cable, the lengths of these suspenders enabling the wing to be fixed at a negative angle of incidence enabling a negative lift that draws the towing cable and the underwater vehicle towards the bottom of the water.

According to a second characteristic, the profile of the wing is that of an inverted aircraft wing.

According to a third characteristic, the device has two supports in the shape of two vertical ailerons fixed to the two rear ends of the wing, in going beyond the trailing edge, the two rear suspenders being fixed to these two supports.

According to a fourth characteristic, the sweep of the wing is substantially equal to 30 degrees.

According to a fifth characteristic, the profile of the wing is of the N.A.C.A. 4409 type.

According to a sixth characteristic, the angle of incidence is substantially equal to 12 degrees.

According to a seventh characteristic, the aspect ratio of the wing is substantially equal to 6, and the length of the suspenders is between a half and two-thirds of the span of this wing.

According to an eighth characteristic, several depressers of a smaller size are placed along the towing cable.

BRIEF DESCRIPTION OF THE DRAWINGS

Other particular features and advantages of the invention will appear clearly from the following description, made as a non-restrictive example, with reference to the appended drawings, of which.

DESCRIPTION OF A PREFFERED EMBODIMENT

Figure 1:
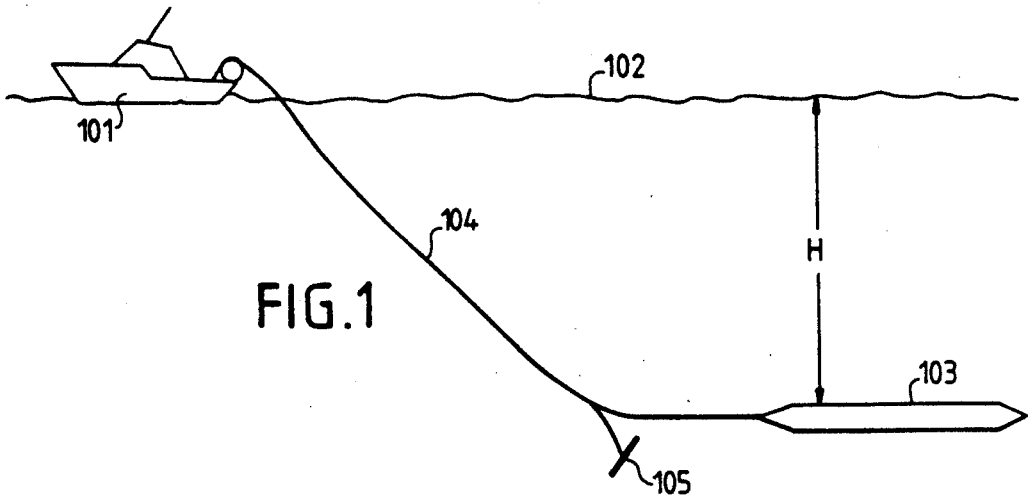
FIG. 1 shows a ship towing a fish kept submerged by a depresser.
Figure 2:
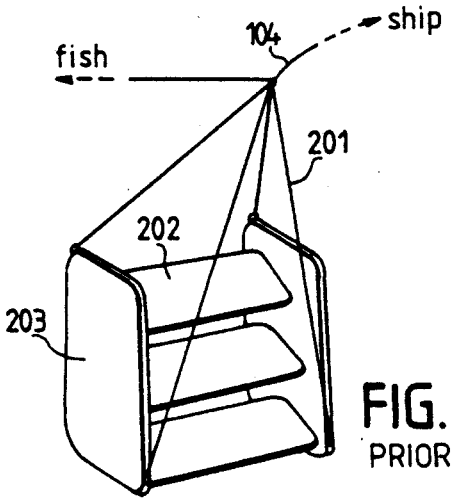
FIG.2 PRIOR ART
FIG. 2 shows a prior art depresser.
Figure 4:
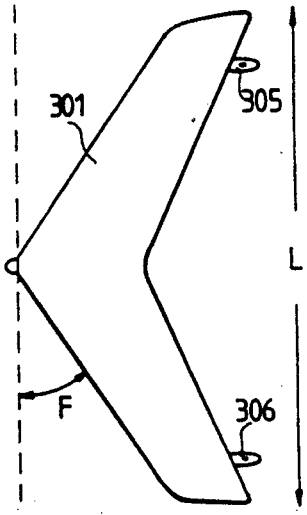
FIG. 4 shows a plane view of this depresser.
Figure 3:
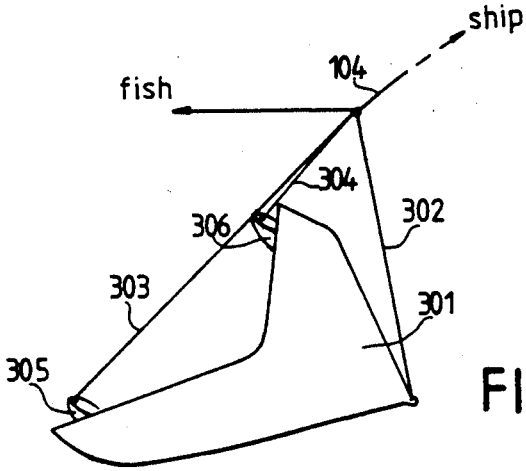
FIG. 3 shows a cavalier projection of a depresser according to the invention.

The depresser according to the invention, shown in FIGS. 3 and 4, consists of a main part 301 which has the shape of a non-dihedral swept wing unit. It is connected to the cable 4 by a rig formed by three suspenders 302 to 304. The suspender 302 is hooked to the front tip of the sweep, and the suspenders 303 and 304 to two supports 305 and 306 hooked beneath the wing towards the end of this wing and going over behind the trailing edge. These supports advantageously take the shape of vertical rudder units that enable the yawing stability of the device to be improved. However, the essential part of the yawing stability is obtained by the high sweep F of the wing. A value of about 30 degrees give satisfactory results.

Figure 5:
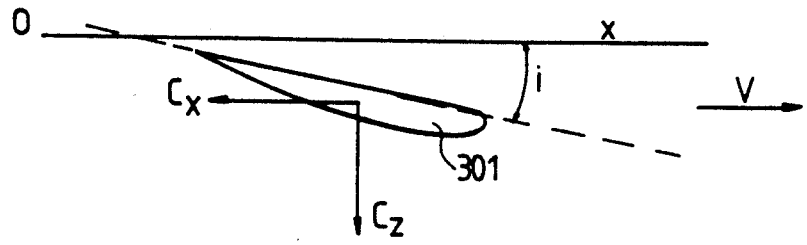
FIG. 5 shows a sectional view of the profile of this depresser.

The two lateral suspenders 304 and 303 have identical lengths. The central suspender 302 has a length that can be adjusted so as to set the attitude positioning of the depresser, that is, the angle of incidence i with respect to the horizontal. FIG. 5 shows a vertical section of the wing 301, which enables this angle of incidence i to be defined with respect to the horizontal ox corresponding to the direction V of the speed of the depresser when it is drawn by the cable 104.

In FIG. 5, it is seen that the profile of the wing has the shape of an inverted aircraft wing profile. This fact, combined with the negative value of the angle i, makes it possible to obtain a downward directed vertical thrust corresponding to the lift of an aircraft wing, but in the other direction.

The hydrodynamic forces exerted on the wing can thus be divided into this negative lift and a drag having a horizontal direction and a direction which is the reverse of that of the speed V.

These two forces correspond to the well-known coefficients $C_x$ and $C_z$.

To obtain a wing having this shape and this profile, it is possible, for example, to forge a thick sheet of a resistant material such as a copper/beryllium or copper/-nickel alloy. According to another approach, this thick plate is milled in the mass, as is done in the aviation industry. This may be easier to achieve for it is easier to have a large-sized side-and-face (three-axis) milling machine than forging presses capable of taking large-sized parts.

In an aircraft, it is absolutely important to use a wing profile that simultaneously has great lift and high aerodynamic efficiency. In the case of a hydrodynamic depresser, it is above all the lift that is important while the aerodynamic efficiency, that is, ultimately, the low value of the drag, counts for little since this drag is in any case low as compared with the power of the towing ship and the drag due to the cable and the fish.

Figure 6:
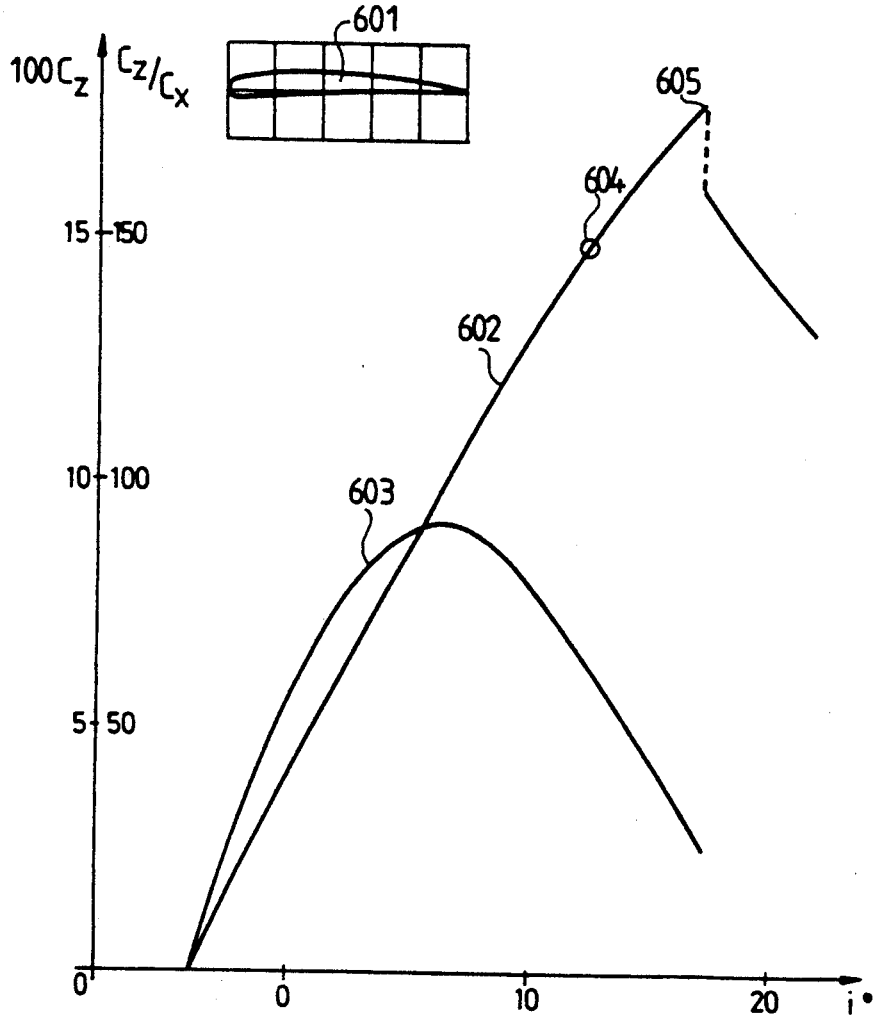
FIG. 6 shows characteristic curves of this depresser.

FIG. 6 shows the characteristic curves of a profile 601 of a type known as N.A.C.A. 4409. The curve 601 represents the lift of the profile (in fact, in this specific case, the negative lift) as a function of the angle of incidence i, and the curve 603 represents the lift/drag ratio $C_z/C_x$ as a function of this same angle i. These curves are established for an infinite aspect ratio A, according to the usual practice. For a finite aspect ratio, which is always the case, a corrective coefficient, known in the prior art, is applied. It is recalled that the aspect ratio is equal to $$\frac{L^2}{S}$$

where L is the span of the wing and S its area.

In a preferred embodiment of the invention, an aspect ratio substantially equal to 6 is used, with suspenders having lengths between a half and two-thirds of the wing span L.

Thus, instead of using suspenders, the length of which makes it possible to obtain an angle i corresponding to the maximum aerodynamic efficiency, i.e. at the tip of the curve 603, we take a point 604 for which the aerodynamic efficiency is, of course, less but for which the lift is substantially greater. This point is chosen in such a way that there is a sufficient safety margin with respect to the point 605 where the wing stalls. As is known, the stalling corresponds to the change to a turbulent mode where the lift suddenly collapses. In the example described, an inclination of the order of 12 degrees is used, for a towing speed of 30 knots. This makes it possible to obtain a lift coefficient that is substantially equal to 0.15. It is seen that the oscillating hydrodynamic depresser thus obtained has high efficiency and is absolutely effective at high speed.

The heavier the towed fish, the thicker the towing cable has to be. This leads to a greater drag, whence an even greater tendency of the whole unit to rise with the speed of the towing boat. It thus becomes necessary, in these cases, to use a very large-sized depresser, one that is much larger than the currently used devices. The fabrication of a depresser of this type is particularly difficult and complicated, especially because it implies that, from a certain point onwards, hollow parts have to be made so that they are not heavy. Besides, such large-sized depressers entail problems of handling and stowage in the ship when they are not being used.

Another approach consists in the use of a faired cable. Apart from the fact that, here too, there are problems in the fabrication of this kind of cable, it would be very complicated to wind it on a drum and, in practice, it would be very difficult to wind it in more than only one layer. Under these conditions, the invention also proposes that, should the dimensions of the depresser become excessive because of the increase in the size and weight of the towed fish, a set of smaller depressers, preferably chosen from among standard models, should be used and that these depressers should be hooked on along the towing cable at places chosen to obtain maximum efficiency of the whole unit. The spacing between the depressers will be fixed so that the cable between two of these depressers does not take an attitude known as a critical angle.

What is claimed is:

1. A device designed to keep an underwater vehicle (103), towed by a ship (101) by means of a towing cable (104), submerged at a substantially constant depth (H), said device comprising a non-dihedral swept wing (103) made of a sheet having a profile of an inverted aircraft wing with an aspect ratio substantially equal to 6, and three suspenders (302, 303, 304) having a length between a half and two-thirds of the span of the wing, said suspenders being fixed at one of their ends, respectively, to a tip and to two rear ends of the wing, and at their other ends to one and the same point of the towing cable, the lengths of these suspenders enabling the wing to be fixed at a negative angle of incidence (i) enabling a negative lift that draws the towing cable and the underwater vehicle (103) towards the bottom of the water.

2. A device according to claim 1, comprising two supports (305, 306) in the shape of two verticle alierons fixed to said two rear ends of the wing, and extending beyond a trailing edge of the wing, and wherein the two suspenders are fixed to these two supports.

3. A device according to claim 1 wherein said wing is made from a solid thick sheet.

4. A device according to claim 1, wherein the sweep (F) of the wing is substantially equal to 30 degrees.

5. A device according to claim 4, wherein the profile of the wing is of the N.A.C.A. 4409 type.

6. A device according to claim 5, wherein the angle of incidence (i) is substantially equal to 12 degrees.

7. A device according to claim 1, comprising several depressers of a smaller size along the towing cable.

8. A device designed to keep an underwater vehicle (103), towed by a ship (101) by means of a towing cable (104) submerged at a substantially constant depth (H), said device comprising a non-dihedral swept wing (103) having a profile of an inverted aircraft wing and three suspenders (302, 303, 304) having a length between a half and two-thirds of the span of the wing, said suspenders being fixed at one of their ends, respectively, to a tip and to two rear ends of the wing, and at their other ends to the towing cable, the lengths of these suspenders enabling the wing to be fixed at a negative angle of incidence (i) enabling a negative lift that draws the towing cable and the underwater vehicle (103) towards the bottom of the water.

* * * * *